United States Patent [19]

Nilberg

[11] 4,423,981

[45] Jan. 3, 1984

[54] CONCRETE LINING OF DRILLED SHAFT

[75] Inventor: Hans Nilberg, Apple Valley, Calif.

[73] Assignee: Santa Fe International Corporation, Orange, Calif.

[21] Appl. No.: 285,815

[22] Filed: Jul. 22, 1981

[51] Int. Cl.[3] ..... E21D 5/01

[52] U.S. Cl. ..... 405/133; 405/132; 405/146; 405/150

[58] Field of Search ..... 405/132, 184, 133–146, 405/150–152, 154–156

[56] References Cited

U.S. PATENT DOCUMENTS

| | | | |
|---|---|---|---|
| 796,423 | 8/1905 | Hoffmann | 405/133 |
| 801,432 | 10/1905 | Albrecht | 405/133 |
| 1,948,733 | 2/1934 | Robertson | 405/184 X |
| 3,250,076 | 5/1966 | Jenkins et al. | 405/133 |
| 3,293,865 | 12/1966 | Loofbourow et al. | 405/133 |
| 3,389,560 | 6/1968 | Zemsky | 405/133 X |

FOREIGN PATENT DOCUMENTS

| | | | |
|---|---|---|---|
| 110898 | 6/1961 | Czechoslovakia | 405/133 |
| 96962 | 10/1960 | Norway | 405/133 |

*Primary Examiner*—Dennis L. Taylor

*Attorney, Agent, or Firm*—LeBlanc, Nolan, Shur & Nies

[57] ABSTRACT

In conjunction with the mining of minerals from the earth, it is necessary to construct deep verticle shafts normally between 10 and 20 feet in diameter and typically between 3000 and 6000 feet in depth in the earth. Technology has been developed for blind drilling of such shafts. After drilling the shaft however, in order to protect those entering the hole for additional mining operations the shaft needs to be lined with a stack of specially constructed lining segments. These segments are formed of prestressed concrete. The concrete segments are lowered one at a time into the bore hole shaft, which is filled with fluid, so as to build up a stack within the hole, thereby lining the hole. Each concrete segment has a top portion with an approximately V-shaped cross-sectional area with a flat top section and a bottom portion having an asymmetrically cross-sectional shape but such shape partially corresponding to the shape of the top portion so that the segments can be stacked. As the segments are stacked, an uneven turbulence is created due to the shapes of the top and bottom portions of the segments. This turbulence helps to flush out any particles from between the concrete segments. Grout is then placed between the lining segments and the inner wall of the bore hole. The grouting process is periodically carried out after every few segments have been placed into the hole. After the lining operation has been completed, the fluid is pumped out of the hole and then the miners can enter the hole for other mining operations.

21 Claims, 8 Drawing Figures

CONCRETE LINING OF DRILLED SHAFT

RELATED APPLICATIONS

The present application is related to commonly assigned U.S. patents applications Ser. No. 134,296 entitled BORE HOLE MINING and filed Mar. 26, 1980, now U.S. Pat. No. 4,330,155 and Ser. No. 165,384 entitled MINE SHAFT LINER and filed July 3, 1980. The contents of such prior applications are hereby incorporated by reference.

BACKGROUND OF THE INVENTION

The present invention relates to the lining of bore hole mine shafts drilled within the earth.

In the mining of minerals, extremely deep bore holes are initially made and then additional holes are extended from the central bore hole. In order to reach many of the mineral deposits within the earth, it is necessary for such holes to extend a depth of between 3000 and 6000 feet into the earth. With the present state of technology, however, the task of drilling such holes and lining the holes with a reinforcing material has been an extremely difficult operation. One type of system for use in such a bore hole mining operation is that system disclosed is the above-noted U.S. patent application Ser. No. 134,296.

In carrying out such mining operations in such bore holes, it is desirable to line the walls of the hole with a lining material. Typically, either steel or concrete lining segments have been used for lining the holes. A plurality of lining segments are stacked one upon another until the entire hole is appropriately lined. In placing the segments into the hole, the hole is filled with a fluid and such fluid is used to support the lining segment as it descends into the hole. The segments, one at a time, are aligned with the top opening of the hole and then released so as to slowly sink into the hole. Keeping in mind, that each of the segments will be in an equilibrium state when $$B-W-G=0$$

where B is the buoyancy force, G is the weight of the casing segment and W is the force of the water inside of the casing. By appropriately adjusting these three variables, each of the segments will be allowed to slowly sink into the hole once released.

Another type of system for lining large diameter bore holes is disclosed in U.S. Pat. No. 3,293,865 to Loofbourow et al. This patent discloses a process by which concrete sections are formed one at a time within the top portion of the bore hole and such sections are then lowered into the hole. More specifically, the disclosure of this patent involves the lining of large diameter deep bore holes by means of a continuous tubular reinforced concrete liner which is cast in a stationary slip form arranged at the top of the hole with such liners after being formed then being lowered into the hole. According to the patent, the holes have a diameter in excess of 3 or 4 feet up to 25 feet and extend for a depth up to 1600 feet. As the concrete lining elements sink into the hole they are supported by the use of fluid within the hole, such fluid being the drilling mud typically used in the drilling operations.

Numerous other devices for lining holes within the earth with either brick or concrete sections have been developed in the prior art. Exemplary of such devices are those shown by U.S. Pat. Nos. 1,003,140 to Lardy, 2,728,600 to Gray et al. and 3,250,076 to Jenkins et al.

The patent to Lardy discloses a system for lining shafts with concrete sections where each section is lowered one at a time into the shaft. The sections are supported by a platform held under the section as it is lowered into the hole. The top of each section is provided with an angular configuration and the bottom has a corresponding angularly configured groove.

In the patent to Gray, the hole within the earth is lined with a section formed by a plurality of bricks arranged on a specially constructed sleeve that is lowered into the hole with the bricks. When the bricks approach the brick section already in the hole, supporting brackets holding the bricks are retracted and the new section of bricks fall into place on top of the bricks already within the hole. The cylindrical sleeve that hold the bricks is then removed from the hole and a new set of bricks is arranged on the sleeve.

The patent to Jenkins discloses a system for lining a shaft within the earth. The system enables any number of prefabricated caisson sections to be lowered into an excavated shaft. The adjacent sections are joined before they are lowered into the shaft so that the joints between the sections themselves may be inspected for flaws before being lowered. In accordance with the procedures set forth in this patent to Jenkins et al. the lowermost caisson section is provided with a suitable support member and a plurality of lowering bars are fastened to such support member. The support member along with the lowering bars cooperate with a plurality of suitable lowering devices such as hydraulic jacks to lower the support member into the shaft. Since the support member must support the entire weight of the stack being formed, both the diameter and the length of the stack is extremely limited.

Other patents illustrating devices for lowering concrete or brick sections into a shaft for lining a shaft are shown in U.S. Pat. Nos. 158,434 to Newcomb, 491,956 to Sumner, 1,169,004 to Cargin, 2,650,477 to Stine and 2,670,233 to Barchoff. Each of these patents discloses a tool for holding a liner section as it is lowered into the shaft in the earth. These shafts being formed in the earth typically only extend to a relatively limited depth with the deepest being a well shaft for a water well such as disclosed in the patent to Sumner.

SUMMARY OF THE INVENTION

An object of the present invention is to provide an improved concrete lining segment and an improved lining procedure for lining large diameter bore holes within the earth.

Another object of the present invention is to provide an improved procedure for stacking cylindrical segments within a bore hole within the earth in order to line such bore hole.

All of the above-noted objectives are achieved by the utilization of the improved concrete liner and lining process in accordance with the present invention.

The concrete liner for the bore hole shaft is formed by a plurality of cylindrical concrete segments. The top portion of each concrete segment has an approximately V-shaped cross-section with a small flat top section. The bottom portion of each segment has a channel area that partially corresponds to the shape of the top portion of the segment so that the segment can be stacked on top of a similarly shaped segment. The channel area of the bottom section is asymmetrical having a flat section for mating with the flat section of the top portion and along its inner edge a slanted section for mating with the inner slanted edge of the top portion of the next lower segment. The top and bottom portions are shaped and dimensioned for creating sufficient uneven turbulence for flushing the surfaces of the mating portions free of any particles. The turbulence creates a flushing force towards the outer extremity of the segment to that the particles are forced towards the outside of the concrete liner.

The precast concrete segments are subject to many stresses. The major stress to which the liner is subjected is hoop stress caused by the outside hydrostatic head pressure. Also, the cylinder will experience tensile stress during lifting, compressive stress from its own weight then installed, and possible bending stress due to shaft hole deviation from a straight line.

The concrete liner cylinder may be designed by using the classical Lame equations or by using empirical formulae presented by Mr. H. H. Hayes of the U.S. Naval Civil Engineering Laboratory ("Concrete Cylinder Structures Under Hydrostatic Loading", ACI Journal, Feb. 1976). These equations along with consideration for shell out-of-roundness, material strength, and stability characteristics will dictate wall thicknesses along with the required steel reinforcement.

As an example, the liner can incorporate the following design criteria:

| | |
|---|---|
| 1. Liner Minimum Inside Diameter | 14 feet |
| 2. Shaft Hole Diameter | 20 feet |
| 3. Concrete Strength | 12000 psi |
| 4. Grout Strength | 4000 psi |
| 5. Maximum External Liner Pressure | 1510 psi |
| 6. Wall Thickness | 2 feet |

Proven results of concrete additives along with proper pouring and curing techniques will yield the high-strength concrete. The high-strength concrete is necessary in order to minimize the wall thickness of the liner.

A concrete cylinder under uniform external pressure can be analyzed using several sets of equations and parameters. The effects of combined stress in the concrete has been neglected. Many independent technical papers have been published based on experimental investigations about behavior of concrete under combined stress. The concrete actually shows an increase in strength during biaxial compression as compared to uniaxial compression. This will increase the established safety factor for the liner structure.

An empirical design equation to predict the implosion pressure of a concrete cylinder as reported by H. H. Haynes in the above-identified paper is:

$$Pim = \theta f'c\left[2.17\frac{t}{Do} - 0.04\right]$$

where:

Pim=Implosion Pressure
f'c=Compressive Strength of Concrete
t=Wall Thickness
Do=Outside Diameter of Cylinder
$\theta$=Length to Diameter Ratio, Equal to 1.0 in this discussion The major limitation to this equation is that t/Do ratios must range between 0.031 and 0.188. Applying the design criteria to this equation yields a safety factor of 1.6 (Safety factor=failure pressure/1510 psi).

Another set of more conservative design formulae is the conventional thick wall theory using the familiar Lame equations (set forth in Roark & Young, "Formulas for Stress and Strain", 5th Ed.). The Lame equations are:

$$\delta_t = \frac{Pb^2}{b^2 - a^2}\left(1 + \frac{a^2}{r^2}\right)$$

$$\delta_r = \frac{Pb^2}{b^2 - a^2}\left(1 - \frac{a^2}{r^2}\right)$$

where:

P=Uniform External Pressure
$\delta_t$=Circumferential Stress
$\delta_r$=Radial Stress
a=Inside Radius
b=Outside Radius
$a<r<b$ Analysis using these equations along with the design criteria yields a safety factor of 2.03.

Because the major loading on the structure itself produces compression stress, the concrete alone can carry these loads without steel structural reinforcement in the liner. However, minimum steel reinforcement is needed to cover volume changes and shrinkage in the concrete mass. Internal stresses due to expansion, contraction, and shrinkage result in cracks which may exceed acceptable limits. Steel reinforcement will also be needed for handling operations. Lifting of the sections will be from the bottom of the section so this will not dictate substantial quantities of steel reinforcement.

Available literature on the effects of grout behind cylindrical liners suggest that there is little increase in the strength of the structure. This is largely due to the nature of the materials and the variables involved. The beneficial aspects of grout are in the distribution of nonuniform loads from the shaft walls and in carrying all of the vertical load through shear. In the conclusions from the Blake study ("Proposed Stress Analysis Criteria for Statically Loaded Deep-Hole Casing System", University of California, Livermore, Dec. 2, 1968), a cylindrical liner surrounded by a grout layer withstood pressure which was 9 to 12 percent higher than that calculated by the collapse pressure formulae. Because of the high specific gravity of the grout, a full standing column of grout may collapse the liner. Grouting should be carried out in lifts or stages of not more than approximately 100 feet.

The system used for stacking the cylindrical concrete segments within a bore hole within the earth is disclosed in prior U.S. patent application Ser. No. 134,296 filed Mar. 26, 1980. Each of the segments has a plurality of radially extending openings at a location near its base. The system is provided with a mandrel from which a plurality of retractable engagement arms radially extend. These retractable engagement arms are arranged near the lower end of the mandrel. Each of the arms projects into a corresponding radial opening in a segment that is to be transported and added to the stack of segments. These radially extending openings in the segment need not extend all the way through the cylindrical segment but need only extend a sufficient distance so as to receive the radially extending arms in order that the mandrel can support the weight of the cylindrical segment. Once the cylindrical segment is supported by the engagement arms on the mandrel, the segment is aligned with the opening of the bore hole and is lowered onto the stack. During the lining process, the hole is maintained full of fluid.

The weight of the segment being added to the stack is held by the system until the segment comes into contact with the stack. The system can either fully support the weight of the segment or partially support the weight of the segment with the weight also being supported by fluid within the bore hole. As the segment being lowered comes near the top segment in the stack, by a bobbing motion of the segment a pumping effect can be created to help flush out any particles on the surfaces between the top segment on the stack and the segment being lowered. Once the cylindrical segment reaches the top of the stack and it is in contact therewith, the engagement arms are retracted from the radial openings in the segment being added. Then the mandrel with the engagement arms can be withdrawn from the bore hole so as to be attached to the next segment to be added to the stack.

The retraction of the engagement arms from the segment only occurs when the segment is no longer supported by the transporting system. After the segment comes into contact with the stack, the mandrel continues to move in a downward direction into the opening of the core of the stack of segments. Such downward movement of the mandrel acts to cause the engagement arms to be retracted from the opening in the segment. For this purpose, rollers are provided on the end of the transport mechanism which sense the inner wall of the top segment already on the stack. Upon coming into contact with the inner wall of the top segment, the rollers cause a latch mechanism that held each of the engagement arms in place to be retracted. The mandrel then continues to move in a downward direction causing gussets attached thereto to force a pin attached to a slidable member of each of the engagement arms to move towards the mandrel thereby causing the slidable member to be retracted into the sleeve of the engagement arm. The mandrel with the engagement arms then in the retracted position is withdrawn from the bore hole back to the surface of the earth. The engagement arms are then reextended so as to enter the radial openings in a new cylindrical segment to be lowered into the bore hole.

When initially starting the procedure for forming the stack of elements, a solid layer of grout is placed on the bottom of the shaft hole. This layer of grout is then dressed with the drill bit so that its surface is perpendicular to the walls of the shaft. This ensures that the stack as formed will be parallel with the walls of the shaft. After a few cylindrical segments have been placed in the hole, grout is applied between the outer walls of the segment and the wall of the hole. This grout is then periodically supplied after a certain number of segments have been lowered into the hole. Thus, for example, after every five segments have been lowered into the hole more grout is added.

The cylindrical concrete segment that is used for forming the liner of the hole has a plurality of radially extending openings at a location near its base. These openings serve to receive the radially extending arms of the transcript mechanism. As previously noted, these openings need not extend all the way through the wall of the cylindrical member but only need extend a sufficient distance so that proper engagement can be made between the transport mechanism and the cylindrical segments for supporting such segment. A reinforcing member surrounds at least the top of each of the radially extending openings. A plurality of longitudinally extending openings are formed within each of the segments, which openings form conduits through the segment. These longitudinally extending openings serve as guide conduits for steel ropes that pass through the segment for guiding the segment as it is lowered into the earth. Alternatively these guide ropes or additional guide ropes can be coupled to the outside of the concrete segments by placing guide hooks around the outside of each segment.

Each segment is lifted one at a time from a location adjacent to the hole and lowered into the hole. The weight of each segment being lowered continues to be supported by the fluid within the hole and the transporting mechanism until the segment comes into contact with the uppermost end of the stack of segments. The segment is retained on the transporting mechanism by radial arms that project into the radial openings in the segment. These arms are retained in contact with the segment and prevented from withdrawing from the segment until the weight of the segment being lowered has transferred from the transporting mechanism to the stack of segments. After the segment comes into contact with the stack of segments and its weight has been transferred to the stack, the arms of the transporting mechanism are withdrawn from the radial openings in the segment. As the segments are lowered into the hole, they are guided by steel guide ropes that extend through longitudinal conduits within the segment.

After a certain number of segments have been placed into the hole, grout is applied between the outer wall of the segments and the inner wall of the hole. This grout is periodically supplied during the lining operation after a certain number of lining segments have been placed into the hole. When initiating the lining operation, a grout plug is formed on the bottom of the bore hole. The grout plug is preferably about 8 feet thick. After the plug is formed, the plug is dressed with the drill bit in a drilling operation so as to ensure that the surface of the plug is perpendicular to the wall of the hole.

The concrete liners must be constructed so as to be able to withstand 0.5 psi per foot of depth, this is the collapse pressure resistance of the liner. Thus, if the hole extends 3000 feet, the collapse pressure resistance of the concrete segments should be in excess of approximately 1500 psi. For a 3000 foot hole the compressive strength of the material of the concrete lining segment should exceed 5000 psi so as to be able to withstand the weight of the segments in the stack.

DESCRIPTION OF THE PREFERRED EMBODIMENTS

Figure 1:
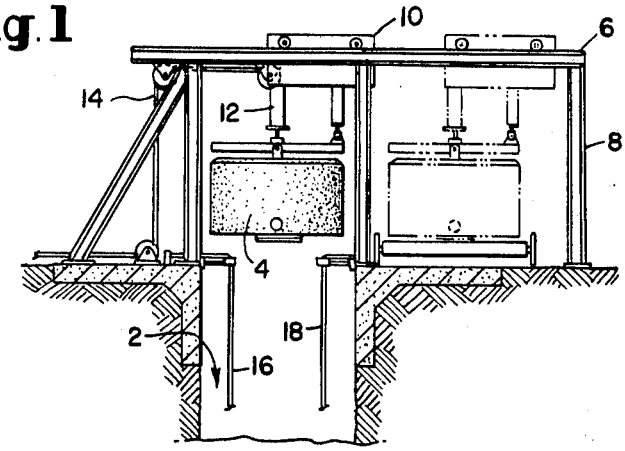
FIG. 1 is a side elevational view illustrating one embodiment of a transporting system for lowering cylindrical segments into a bore hole in accordance with the present invention.

A bore hole 2 that has been drilled into the earth can be lined with a plurality of cylindrical segments, such as segment 4, that are lowered into the hole by a transporting mechanism such as shown in FIG. 1. Transporting mechanism 6 picks up the segment that is to be lowered from a location adjacent the hole and with an overhead crane 10 arranges the segment over the opening to the hole. The segment is then lowered into the hole utilizing an hydraulic mechanism 12. The segment as it is lowered is supported by a steel rope 14 and is guided by steel guide ropes such as ropes 16 and 18. Guide lines 16 and 18 pass through longitudinally extending openings in the cylindrical segment and extend through all of the segments as the stack is formed. While FIG. 1 illustrates one embodiment of the transporting mechanism, another, and preferred, embodiment is described in abovementioned U.S. patent application Ser. No. 134,296.

Figure 2:
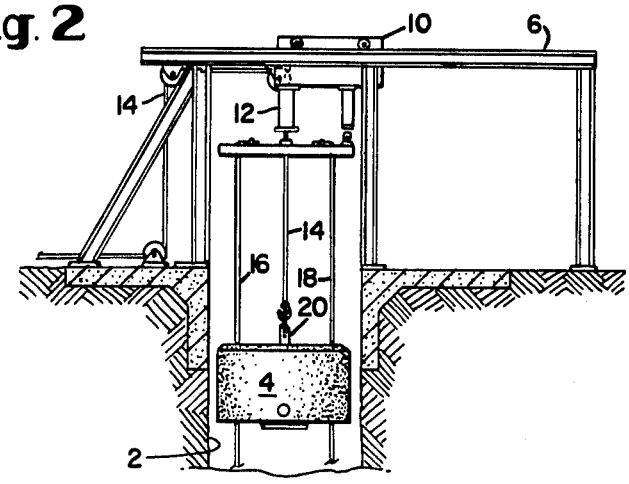
FIG. 2 is another view of the system illustrated in FIG. 1 showing the cylindrical segment partially lowered into the hole.
Figure 3A:
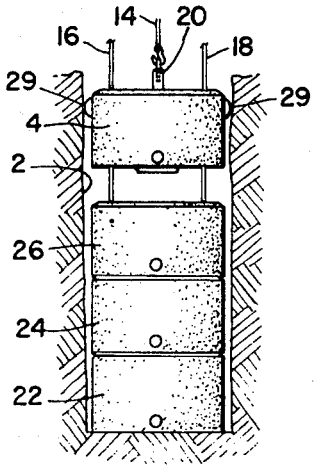
FIG. 3*a* is a side elevational view showing a cylindrical element being lowered into a bore hole and added to a stack of elements already within the hole.
Figure 3B:
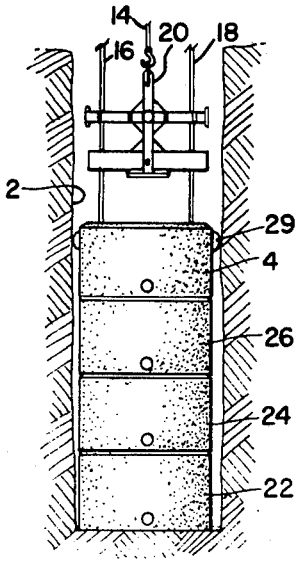
FIG. 3*b* is a side elevational view showing a stack of elements formed within a hole with the transporting mechanism being withdrawn from the hole for picking up another cylindrical segment.

As shown in FIG. 2, after guide lines 16 and 18 have been threaded through the longitudinal openings in segment 4, hydraulic mechanism 12 lowers support line 14 which is attached to mounting bracket 20. Attached to mounting bracket 20 is the support mechanism for supporting cylindrical segment 4 as it is lowered into the hole. As cylindrical segment 4 is lowered into the hole, it is added to a stack of cylindrical segments 22, 24 and 26 already formed in the hole (see FIG. 3*a*). After segment 4 has come to rest on top of segment 26, the support member is withdrawn from segment 4 and drawn back to the surface of the earth by withdrawing support line 14. Thus a stack of cylindrical segments 22, 24, 26 and 4, such as shown in FIG. 3*b*, is formed within bore hole 2. Upon withdrawal of the support member, a new cylindrical segment is picked up from the location adjacent to the hole and then lowered into the hole for continuing the formation of the liner for the bore hole. After several cylindrical segments have been stacked within the hole, grout can be added between the outer wall of the segments and the inner wall of the hole by any type of conventionally known equipment. The grout is then periodically supplied after a certain number of cylindrical segments have been arranged in the hole such as every third, fifth or tenth segment.

The cylindrical segments are formed from a prestressed concrete. A cross-sectitonal view of such concrete cylindrical segment is illustrated in FIG. 4*a* and an enlarged cross-sectional view of the top and bottom portions appears in FIG. 4*c*. Cylindrical segment 4 has an inner wall 27 and an outer wall 31. Extending in a radial direction near the bottom of segment 4 from inner wall 27 are a plurality of openings such as openings 28 and 30. The number of such openings are typically either three or four openings with the openings being equidistantly spaced around the inner wall. While the openings need not extend all the way through the wall, the open portion must be facing the inner portion of the cylindrical segment. Each of the radial openings should be reinforced by a reinforcing material 32 which can be a steel pipe that extends into the opening. Positioned around the outer wall are a plurality of centralizers such as 29, formed from an epoxy material. These centralizers need only be placed on every third or fourth lining segment or as needed. Extending in a longitudinal direction through the wall of segment 4 are a plurality of longitudinal openings such as openings 34 and 36. These longitudinally extending openings serve as the guide channels for the guide lines, such as steel lines 16 and 18.

The top of each of the segments is formed with an approximately V-shaped construction such as top portion 38. A partially corresponding channel area 40 is provided in the bottom of segment 4. (See FIGS. 4*a*, 4*b* and 4*c*.)

Top portion 38 has at its pinnacle a small flat area 50 between two slanted sides 52 and 54 which forms the approximately V-shaped cross-sectional area. The channel area 40 along the bottom of the concrete segment is asymmetrical and only partially corresponds to the shape of top portion 38. The channel area 40, however, must be shaped and dimensioned so that the bottom portion of one concrete segment can easily rest upon the top portion of the next lower concrete segment. Channel area 40 has a flat section 56 with two adjacent sloping walls 58 and 60. The flat section 56 of channel area 40 rests upon the flat portion 50 of top portion 38 and slanted wall 58 of channel area 40 mates with slanted wall 52 of top portion 38. The construction of these related top and bottom portions helps to create an uneven turbulence as the bottom of one concrete section approaches the top of the next lower concrete section during the lining process. The turblence created in the fluid that is in the drilled hole is uneven in the area between the top and bottom portions due to the asymmetrical shape of channel area 40. This turbulence creates a force towards the outer edge of the concrete sections for helping to flush out any particles or rubble that may settle on the bearing surfaces of the liner segments during installation. Thus the rubble is flushed down the slope of the surfaces, hopefully the outer surface 54 of top portion 58 by the hydraulic turbulence created by the approaching segment.

To help in the flushing out of the rubble between the bearing surfaces of the concrete segments, it is desirable that flat portion 50 have a dimension of approximately $2\frac{1}{2}$ to $3\frac{1}{2}$ inches and that slanted walls 52 and 54 each be slanted at an angle $\alpha$ with respect to the horizontal of 45°.

Figure 4C:
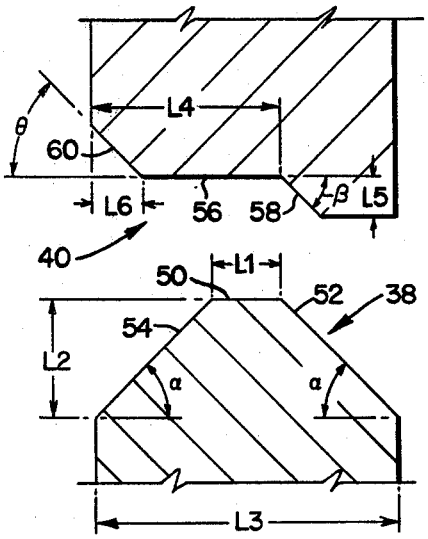
FIG. 4*c* is an enlarged cross-sectional view of mating top and bottom portions.
Figure 4A:
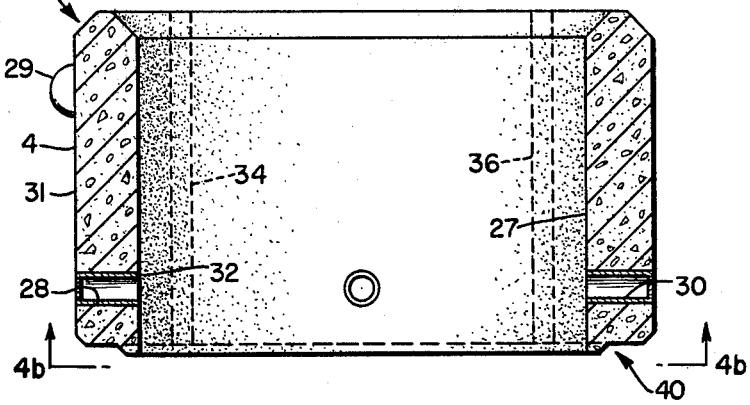
FIG. 4*a* is a side elevational cross-sectional view of a concrete cylindrical segment formed in accordance with the present invention.
Figure 4B:
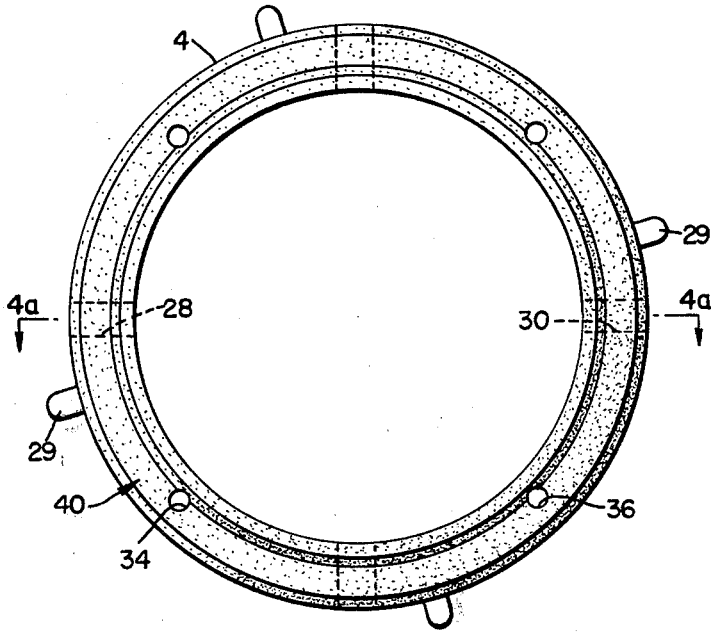
FIG. 4*b* is a top plan view of the concrete cylindrical segment shown in FIG. 4*a*.

In the exemplary embodiments shown in FIG. 4*c*, the distance L1 is 3 inches, L2 6 inches and L3 15 inches for top portion 38. Corresponding channel area 40 has the following dimensions in this exemplary embodiment: L4 is $9\frac{3}{8}$ inches, L5 is 2 inches and L6 is $1\frac{1}{2}$ inches. The angles $\beta$ which is the angles of slanted walls 58 and 60 with respect to the horizontal is 45°.

Where a hole of approximately 20 feet in diameter is drilled to a depth of over 3000 feet then concrete segments are used with the inner diameter of segment 4 preferably being approximately 14 feet and the outer diameter being approximately 18 feet. Thus the wall thickness of segment 4 is approximately 2 feet. The length of each segment is approximately 10 to 15 feet.

Figure 5:
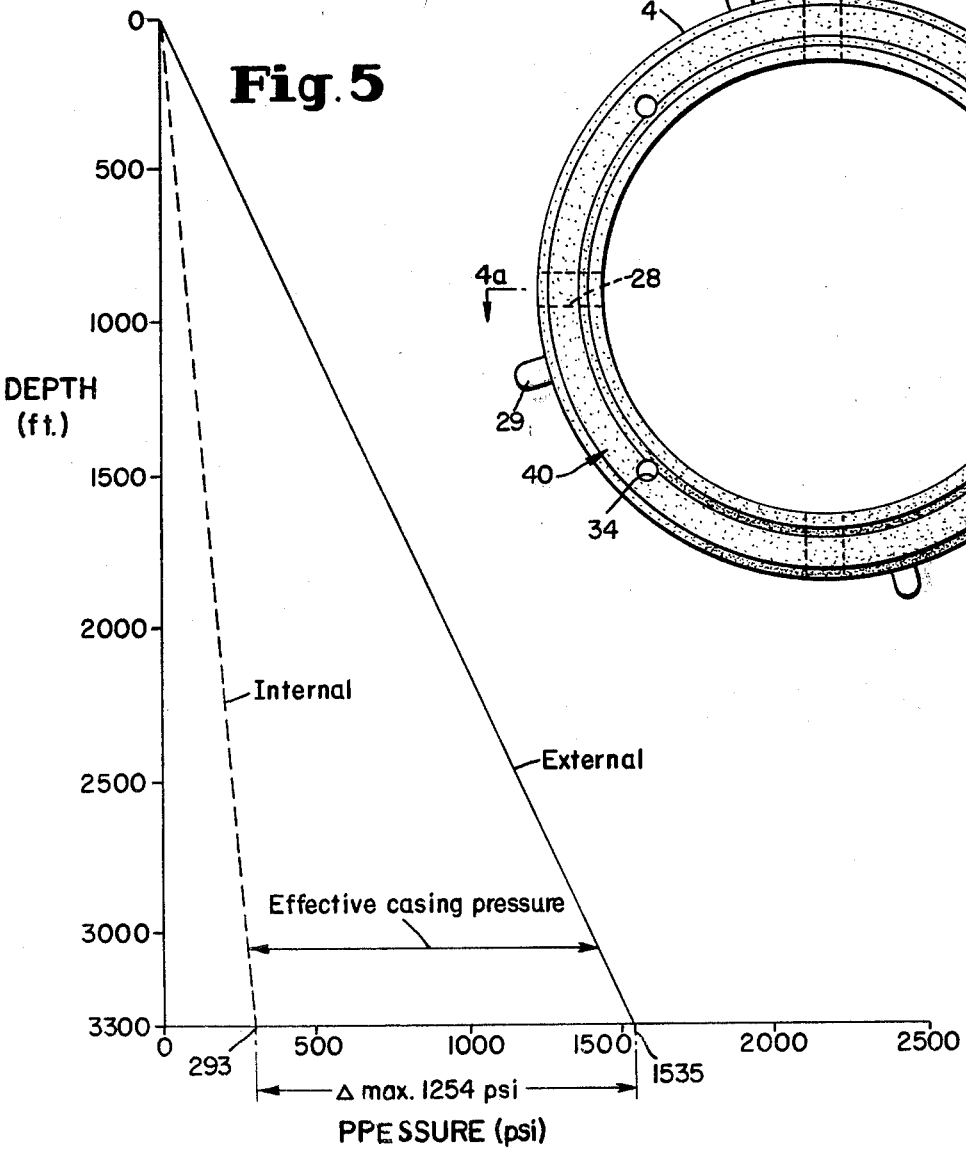
FIG. 5 is a graph illustrating the relationship between the depth to which the cylindrical segments are to be lowered and the pressure on the inner and outer walls of such segment where the segment is formed of concrete.

In forming the prestressed concrete segment 4, the segment must be capable of withstanding the pressure differential between the pressure on the inside wall and the outside wall of the fluid within the hole. As shown by the graph in FIG. 5, the effective casing pressure on the internal wall is illustrated by the dashed lines while the pressure on the outside wall is shown by the solid line. The lines in the chart have been plotted with respect to a concrete cylinder having an inner diameter of 14 feet and an outer diameter of 18 feet. This pressure obviously increases with the depth of the hole. The effective casing pressure is the differential between the pressure on the inside and outside walls of the cylindrical segment. Thus, for a concrete segment such as described above, the effective casing pressure resistance should be in excess of 1000 psi in order to be able to use the segment at 3000 feet or more preferably in excess of 1200 psi. At 3300 feet as shown in the graph of FIG. 5, the pressure differential is 1254 psi. The pressure relationship illustrated by the graph of FIG. 5 has been calculated utilizing a pressure gradient of 67 pounds per cubic foot of mud.

Grout is placed behind the liner after the first segment is positioned, and then after the placement of approximately every 10 concrete segments. This grouting procedure helps to maintain centralization of the liner. In addition the grouting procedure minimizes compression forces since it transfers the liner weight to th shaft wall. The steps taken to ensure that the segments are centralized within the shaft serves to avoid any horizontal forces that might otherwise be created. Such horizontal forces, i.e. shear forces, would tend to split the concrete if of a large enough magnitude. The transfer of the compressive forces helps to avoid undue pressures upon the stack of concrete segments, particularly as the stack becomes fairly sizable.

Each of the concrete segments should be made using high strength concrete. One technique for providing such high strength is by employing polymer or latex type additives in the concrete mixtures. Each cylinder must be provided with a sufficient compressive strength which ideally should be approximately 12000 psi or greater. Using those equations set forth above, in constructing the segments, the segments should be provided with a safety factor in excess of 1.5 and preferably in excess of 2.0 so that the cylinders are able to withstand a hydrostatic head at 1500 feet of 650 psi. The implosion pressure for each segment should be in excess of 1300 psi. Using these various criteria, a concrete cylinder of 12000 psi concrete, with a 14 feet inner diameter and a 24 inch wall thickness is able to withstand 3200 feet of water.

Every segment of the liner will be subjected to combined stresses acting in all three major directions, i.e. longitudinal, circumferential and radial. The dead load weight of the structure itself will produce compression stress in the longitudinal direction of the liner segment. Hydrostatic pressure will produce compression stress in both circumferential and radial directions of the liner segment. Stress in the radial direction will be relatively small and equal to the hydrostatic pressure at the outside surface of the liner, decreasing to zero at the inner surface of the liner. Thus for practical reasons it can be assumed that the liner will be under biaxial stress state, i.e. longitudinal and circumferential compression.

While the segment walls may be 1 to 2 feet, they are tapered to a 3 inch horizontal face as previously discussed. The main consideration is narrowing the face to this width is minimizing the flat surface exposed to incidental particles, fines or coarse rubble that may be caused to fall from the shaft wall during the lining operation. Any particle over 3 inches in diameter and falling through the drilling fluid would become unbalanced on impact with the segment surface and be caused to fall away from that surface. Any particle under 3 inches in diameter may settle on the liner surface. The following descending segment is stopped automatically some 3 feet above the cylinder in place. Turbulence or flushing action is then created by moving the segment up and down a number of times. When the segment is lowered to make contact, the safety mechanism on the running tool will release only if the two segments are in contact. Any rubble between the segment surfaces will separate these surfaces and prevent the running tool from releasing. The pumping action is then repeated. It is felt that the probability of proper seating is high since no routine settlement of rubble is expected.

Safety factor on all cables under tension will be a minimum of 1.5. Each of the three cylinder guide cables is $1\frac{1}{2}$ inches diameter with a breaking strength of at least 150,000 pounds. A tension of 20,000 pounds will be applied to each of these cables. This tension is within the range of rope-guide tension of Galloway stages commonly used in conventional sinking, and adequate for stabilizing the cylinder being run. The main winch cable is $2\frac{1}{2}$ inches diameter with a breaking strength of 300,000 pounds. Minimum tension is applied to the $\frac{5}{8}$ inch diameter grout line guide cables since their sole purpose is to guide the grout lines into the annular space between the first liner cylinder and the shaft wall. A crushing load evaluation is made as follows:

$$H\left\{\frac{D^2}{2}(\pi)-\left(\frac{d}{2}\right)^2(\pi)\right\}=V$$

where:

V=Volume

H=Cylinder height

D=Outside diameter d=Inside diameter

The total contact area at top of each concrete segment is calculated as follows:

$$(\pi)\quad(N)(W)-A$$

where:

N=Cylinder diameter to center of horizontal face

W=Width of horizontal face

A=Area of horizontal face

Where the crushing load on a single cylinder is 78 psi, the concrete compressive strength is 12,000 psi and the cylinder height is 15 ft. then the crushing load on a free standing column 150 ft. high is 780 psi and each segment should have the ability to withstand such loads. Grouting takes place every 150 feet and the liner weight is transferred to the shaft wall. Shear force at the shaft wall with the combined weight of liner and grout is for example:

Weight of cylinder+weight of grout=combined weight 148,000=126,000=274,000 lbs.

Contact area=942.5 sq. ft. or 135,717 sq. in.

$$\text{Shear force} = \frac{274{,}000 \text{ lbs.}}{135{,}717 \text{ sq. in.}} \; 2.02 \text{ lbs./sq. in.}$$

An exemplary mixture for forming the high strength concrete contains the following composition:

| | |
|---|---|
| Cement | 900 |
| Corrocem | 180 |
| Sand | 1000 |
| Super Plasticizer | 170 oz. |
| Coarse Aggregate | 1900 |
| Water | 26.9 |
| % Air | 1.0 |
| Initial Slump | 6.0 |
| Water Cement Ratio | 0.249 |

Each of the concrete segments preferably should be coated with a spray-on resin coating which can contain methyl methacrylate. This resin coating prevents the water in the drilled hole from entering the pores within the concrete segment. Such water otherwise could decrease the resistance of the concrete segment to implosion pressure.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A liner for a bore hole shaft formed of a plurality of cylindrical concrete segments, each said concrete segment comprising: a top portion with an approximately V-shaped cross-sectional area with inner and outer slanted sections and a small flat top section; and a bottom portion having a channel area partially corresponding to the shape of the top portion so that said segment can be stacked on top of a similarly shaped segment, said channel area of said bottom portion having an asymmetrical cross-section with a flat section for mating with said flat section of said top portion, a slanted section along its inner edge for mating with said inner slanted section of said top portion and an outer section extending in a direction away from said outer slanted section of said top portion so that when said bottom portion of one of said concrete segments is lowered onto said top portion of another of said concrete segments a sufficient uneven turbulence is created between the two said concrete segments for flushing surfaces of said portions free of any particles and flushing such particles towards the outer extremity of said segments.

2. A liner having cylindrical concrete segments according to claim 1 wherein the angle of each of the inner and outer sections of said approximately V-shaped top of each said segment incorporates an angle of 45°.

3. A liner having concrete segments according to claim 2 wherein said flat section of said top portion of each said segment is approximately between 2½ and 3½ inches.

4. A liner having concrete segments according to claim 3 wherein said approximately flat section and said slanted sections of said top portion of each said segment incorporates an angle of approximately 90°.

5. A liner having concrete segments according to claim 4 wherein each said segment is constructed of prestressed concrete having an inner diameter of at least 10 feet and having an effective casing pressure resistance of at least 800 psi.

6. A liner having concrete segments according to claim 5 wherein the thickness of the concrete wall of each said segment is approximately 1 to 2 feet.

7. A liner having concrete segments according to claim 6 wherein each said segment has an inner diameter of approximately 14 to 16 feet and an outer diameter of approximately 18 feet.

8. A liner having concrete segments according to claim 7 wherein each said segment has an effective casing pressure resistance of over 1200 psi.

9. A liner having concrete segments according to claim 7 wherein the length of said segment is approximately 10 to 15 feet.

10. A liner having concrete segments according to claim 1, 2, 3 or 5 wherein grout is placed between said liner and the bore hole shaft after the first of said segments is positioned and then after the placement of every ten of said segments for maintaining centralization of said liner and minimizing compression forces on said segments by transferring the weight of said liner to the walls of the bore hole shaft.

11. A liner for a bore hole shaft formed of a plurality of cylindrical concrete segments, each said concrete segment comprising: a top portion with an approximately V-shaped cross-sectional area with inner and outer slanted sections and a small flat top section; and a bottom portion having a channel area having an asymmetrical cross-section only partially corresponding to the shape of said top portion so that said segment can be stacked on top of a similarly shaped segment; said channel area of said bottom portion having an outer wall being shaped and dimensioned so as to be sufficiently spaced away from the corresponding said outer slanted section of said top portion so that when said bottom portion of one of said concrete segments is lowered onto said top portion of another of said concrete segments a sufficient uneven turbulence is created for flushing surfaces of said portions free of any particles and flushing such particles towards the outer extremity of said segments; and said concrete segment having a safety factor in excess of 1.5.

12. A liner having concrete segments according to claim 11 wherein said concrete segment has a compressive strength of approximately 12,000 psi.

13. A liner having concrete segments according to claim 11 wherein said concrete segment has the ability to withstand an implosion pressure of from 850 to 1300 psi.

14. A liner having concrete segments according to claim 11, 12 or 13 wherein the segments are able to withstand a crushing load of approximately 780 psi.

15. A liner having concrete segments according to claim 11 wherein each said segment is constructed of prestressed concrete having an inner diameter of at least 10 feet and having an effective casing pressure resistance of over 1000 psi.

16. A liner having concrete segments according to claim 15 wherein the thickness of the concrete wall of each said segment is approximately 1 to 2 feet.

17. A liner having concrete segments according to claim 16 wherein each said segment has an inner diameter of approximately 14 feet and an outer diameter of approximately 18 feet.

18. A liner having concrete segments according to claim 17 wherein each said segment has an effective casing pressure resistance of over 1200 psi.

19. A liner having concrete segments according to claim 17 wherein the length of said segment is approximately 10 to 15 feet.

20. A liner having concrete segments according to claim 11, 12, 13, 15 or 19 wherein grout is placed between said liner and the bore hole shaft after the first of said segments is positioned and then after the placement of every ten of said segments for meintaining centralization of said liner and minimizing compression forces on said segments by transferring the weight of said liner to the walls of the bore hole shaft.

21. A method for lining a bore hole shaft with a plurality of cylindrical concrete segments for forming a stack of such concrete segments including the steps of: forming the liner of segments from the bottom of the bore hole up; completely lowering each segment one at a time while the bore hole is filled with drilling fluid; only lowering the next segment after the prior segment has been completely lowered onto the stack of segments; and as each segment is lowered to the top of the stack of segments creating an uneven turbulence between such adjacent segments for creating a force towards the outer extremity of the segments for flushing out any rubble between the bearing surfaces of the segments coming into contact.

* * * * *